US007675466B2

(12) United States Patent
Gaucher et al.

(10) Patent No.: US 7,675,466 B2
(45) Date of Patent: Mar. 9, 2010

(54) ANTENNA ARRAY FEED LINE STRUCTURES FOR MILLIMETER WAVE APPLICATIONS

(75) Inventors: Brian Paul Gaucher, Brookfield, CT (US); Duixian Liu, Yorktown Heights, NY (US); Ranjani Sirdeshmukh, Hastings-on-Hudson, NY (US)

(73) Assignee: International Business Machines Corporation, Armonk, NY (US)

( * ) Notice: Subject to any disclaimer, the term of this patent is extended or adjusted under 35 U.S.C. 154(b) by 300 days.

(21) Appl. No.: 11/772,464

(22) Filed: Jul. 2, 2007

(65) Prior Publication Data

US 2009/0009399 A1 Jan. 8, 2009

(51) Int. Cl.
*H01Q 1/38* (2006.01)
*H01Q 1/00* (2006.01)

(52) U.S. Cl. ..... 343/700 MS; 343/905

(58) Field of Classification Search ..... 343/700 MS, 343/795, 846, 905
See application file for complete search history.

(56) References Cited

U.S. PATENT DOCUMENTS 4,686,535 A 8/1987 Lalezari
5,712,644 A 1/1998 Kolak
7,391,372 B2 * 6/2008 Lynch et al. ..... 343/700 MS
2006/0220760 A1 * 10/2006 Floyd et al. ..... 333/26
2008/0252543 A1 * 10/2008 Pettus ..... 343/793

OTHER PUBLICATIONS

Ely Levine, et al., "A Study of Microstrip Array Antennas With the Feed Network," pp. 426-434, IEEE Transactions on Antennas and Propagation, vol. 37, No. 4., Apr. 1989.

* cited by examiner

*Primary Examiner*—Shih-Chao Chen
(74) *Attorney, Agent, or Firm*—F. Chau & Associates, LLC

(57) ABSTRACT

Improved feed line networks for antenna arrays operating at millimeter wave frequencies are provided for constructing planar antenna arrays printed on the surface of a dielectric substrate. A planar antenna array includes an array of planar radiator elements interconnected through a feed line network of planar coplanar transmission lines that enable high-efficiency operation, at millimeter wave operating frequencies. For example, a feed network may be formed with a network of coplanar strip line transmission lines including one or more coplanar strip line (CPS) and one or more coplanar waveguide (CPW) transmission line, which are interconnected using balun structures, to enable high efficiency operation at millimeter wave frequencies.

19 Claims, 6 Drawing Sheets

ANTENNA ARRAY FEED LINE STRUCTURES FOR MILLIMETER WAVE APPLICATIONS

GOVERNMENT LICENSE RIGHTS

This invention was made with Government support under Contract No. N66001-02-C-8014 and N66001-05-C-8013 awarded by DARPA (Defense Advanced Research Projects Agency). The Government has certain rights in this invention.

TECHNICAL FIELD OF THE INVENTION

The present invention generally relates to improved feed line networks for antenna arrays operating at millimeter wave frequencies and, in particular, a planar antenna array printed on the surface of a dielectric substrate wherein the planar antenna array includes an array of planar radiator elements interconnected through a feed line network of planar coplanar transmission lines to provide high-efficiency operation at millimeter wave operating frequencies.

BACKGROUND

In the wireless communications industry, market demands for ubiquitous network access to information and services has been met with rapid and widespread development of wireless network applications for wireless PAN (personal area network), wireless LAN (local area network), wireless WAN (wide area network), cellular networks, and other types of wireless communication systems. Moreover, recent advances in semiconductor technologies and microwave and millimeter-wave planar antenna circuit technologies have made it possible to combine the solid-state devices with the planar antennas to produce more compact, reliable and wide-band microwave and millimeter-wave devices.

In general, micros trip antenna technologies are commonly used for integrated RF solutions as microstrip antennas (or printed antennas) such as microstrip patch antennas (or patch antenna) allow for low profile, low cost and reliable antenna designs. As is well known in the art, a patch antenna is typically fabricated by patterning an antenna radiator element on one side of an insulating dielectric substrate that has a continuous metal layer (ground plane) on the opposite side of the substrate. A single patch antenna provides a maximum directive gain of around 6-9 dBi. For applications such as wireless USB, where the operating distance is limited to about a meter, a single patch antenna with about 7 dBi of gain at an operating frequency of 60 GHz will provide the necessary antenna gains. However, for distances of 10 meters or more or other point-to-point applications, antenna gains as high as 40 dBi are needed depending on the application. To achieve such high gain, antenna arrays with as many as 256 radiating elements are typically required.

Planar antenna arrays are generally designed with 2D array of radiating elements, such as microstrip patches, dipoles, folded dipoles, slots, etc., that are interconnected using a microstrip feed line network such as a corporate feed network, a series feed network or a combination of corporate and series feed networks. By way of example, FIG. 1 illustrates a conventional architecture of a microstrip patch antenna array (100) having a 2D array (4×4) of 16 microstrip radiator patch elements (110) are uniformly arranged in two rows of four patch elements (110). It is assumed that the array (100) is a formed on one side of a dielectric substrate having a ground plane disposed on an opposite side thereof. The array of patch elements (110) are interconnected using a corporate structured feed line network comprising successive divisions of plurality of microstrip lines (120~123) to connect each patch element (110) to a common feed point node (FP) in parallel. The corporate feed structure comprises a central main microstrip line (120) and a plurality of interconnecting branch lines (121, 122 and 123) that connect the main line (120) to each of the patch elements (110). The branch lines (121) are connected to the ends of the main line (120) and extend at right angles to the main line (120). The branch lines (122) are connected to the ends of the branch lines (121) and extend at right angles to the ends of the branch lines (121). The branch lines (123) are connected to the ends of the branch lines (122) and each branch line (123) feeds a pair of patches (110). Each patch element (110) is feed by the branch line (123) in the array on the same side edge at a center point of the side.

In the conventional corporate-structured microstrip feed line structure of FIG. 1, the RF signal input/output point (FP) is located at the center point along the main feed line (120) in the central region of the array (100). As shown in FIG. 1, the feed point (FP) is shown located at the origin of orthogonal dotted lines X-X and Y-Y. The array (100) is arranged to be a mirror image about line Y-Y, and a substantially symmetrical about line X-X, for purposes of providing an equal transmission line path length from the common feed point FP to each of the individual radiator patches (110) along portions of the lines (120-121-122-123). With this arrangement, all patches (110) are fed in a common phase and the power of the RF signal is split at each juncture between branches. Conventional impedance matching techniques are utilized at each juncture and at each connection point with an individual radiator patch (110) to minimize reflection. Moreover, the spacing Dx between patch elements (110) in the row direction are typically selected so that the elements are electrically separated by a one-half of the free-space wavelength or some value less than one free-space wavelength. Similarly, the spacing Dy between the feed edges of the patch elements (110) in the column direction is typically selected to be one-half of the free-space wavelength. This arrangement ensures that current delivered to each patch (110) from, the feed point FP has the same amplitude and phase to thereby enhance the distribution/combination of microwave power to/from the patch element (110) at the feed point (FP) and to avoid grating lobes.

Although FIG. 1 illustrates an array of 16 patches, in certain wireless communication applications, a large number of radiating patch elements (e.g., 256 patches) are needed to achieve high gain, resulting in large arrays. As the size of the antenna array increases (and size of microstrip network) or as the operating frequency increases, the use of microstrip feed line networks are problematic. However, as the number of patches used in a microstrip antenna array increases, it may be difficult to obtain the desired gain characteristics dues to large feeding losses that result from the antenna feed network. Indeed, a corporate microstrip feed network, like any feed network, will result in a certain amount of loss of antenna efficiency and gain, due to losses in the microstrip lines, undesired radiation from, the lines, and mutual coupling between patches via surface waves. In this regards, the architecture of the feed network is a critical factor in the design process, especially for large arrays.

Moreover, it is well known that a microstrip antenna structure having a microstrip feed network and patch array on the same level (on the same substrate surface) cannot be optimized simultaneously because the requirements for microstrip antennas and microstrip transmission lines are different. For microstrip patch antennas, the relative permittivity and thickness of the substrate largely determines the electrical characteristics of the antenna a low dielectric constant substrate enhances the radiation efficiency of the antenna while a thicker substrate increases antenna bandwidth. However, lower dielectric constant substrates and thicker substrates can result in spurious radiation from microstrip line and step discontinuities. For applications at operating frequencies lower than millimeter wave frequencies (e.g., less than about 30 GHz), microstrip feed lines can be readily implemented on printed circuit board (PCB) with substrate as thin as 300 microns. For low frequency application, microstrip lines are well behaved and have acceptable electrical characteristics, e.g., acceptable dispersions, relatively constant characteristic impedance over operating band of interest, and low coupling between feed lines and radiating elements (due to weak, fringe fields).

However, for applications at millimeter wave operating frequencies and beyond, microstrip patch antenna arrays cannot be easily implemented on a substrate as thin as 100 um or thinner due to mechanical reliability and limitations of the manufacturing process, as is understood by those of ordinary skill in the art. As a result the substrate is usually too thick for microstrip lines operating at mmWave and higher frequencies. Due to the too thick substrate thickness, microstrip line impedance changes significantly with frequencies due to dispersion. In addition, the microstrip line fringe field is very strong because of the lower ratio of the microstrip line width to the substrate thickness. Under these conditions, the microstrip line does not properly operate as a feed line, but operates as a radiating element as well. Therefore, for millimeter wave frequencies and beyond, it is virtually impossible to design efficient planar antenna arrays with coplanar microstrip lines, even for small arrays with, e.g., four elements.

SUMMARY OF THE INVENTION

In general, exemplary embodiments of the invention include improved feed line networks for antenna arrays operating at millimeter wave frequencies. In particular, exemplary embodiment of the invention include methods for constructing planar antenna arrays printed on the surface of a dielectric substrate wherein the planar antenna arrays are designed with an array of planar radiator elements interconnected through a feed line network of planar coplanar transmission lines which enable high-efficiency operation at millimeter wave operating frequencies. For example, an antenna array comprising an array of antenna radiator elements and feed network that is coplanar with the antenna elements can be formed with the feed network comprising coplanar strip line transmission lines including one or more coplanar strip line (CPS) and one or more coplanar waveguide (CPW) transmission line, which are interconnected using balun structures.

More specifically, in one exemplary embodiment of the invention, an antenna includes a planar substrate comprising an antenna array comprising an array of planar radiating elements and a feed network formed on a surface of the planar substrate. The planar radiating elements include a first pair of patch radiators including a first patch radiator having a first edge, and a second patch radiator having a second edge. The first and second patch radiators are arranged such that the first and second edges are adjacent edges that are spaced apart and face each other. The feed network comprises a first balanced coplanar strip line having first and second signal lines. The first balanced coplanar strip line is disposed between the first and second edges of the first and second patch radiators. Moreover, a first conductive strip connects the first signal line to the first edge of the first patch radiator, and a second conductive strip connects the second signal line to the second edge of the second radiator patch.

In one exemplary embodiment, the antenna is configured such that the first and second edges are points of opposite phase for a given operating frequency and the first and second patch radiators are fed by the first balanced coplanar strip line such that the first and second patch radiators radiate in phase.

In another exemplary embodiment of the invention, an antenna includes a planar substrate comprising an antenna array comprising an array of planar radiating elements and a feed network formed on a surface of the planar substrate. The feed network includes a network of coplanar strip line transmission lines that include one or more coplanar strip lines (CPS) and one or more coplanar waveguide (CPW) transmission lines. The feed network may comprise a corporate feed structure or a combination of a corporate feed and series feed network.

The feed network further comprises one type of balun structure to connect a CPW transmission line and a CPS transmission line, which are transversely disposed to each other, and another type of balun structure to connect two CPS transmission lines that are transversely disposed to each other.

In another exemplary embodiment of the invention, the planar radiating elements are arranged in pairs where each pair of radiating elements is differentially fed by a balanced CPS transmission line. The radiating elements may be rectangular patch elements, wherein each pair of radiating elements includes a first patch radiator having a first edge, and a second patch radiator having a second edge. The first and second patch radiators are arranged such that the first and second edges are adjacent edges that are spaced apart and face each other. The balanced CPS transmission line includes first and second signal lines disposed between the first and second edges of the first and second patch radiators, wherein a first conductive strip connects the first signal line to the first edge of the first patch radiator and a second conductive strip connects the second signal line to the second edge of the second radiator patch. In this embodiment, the balanced CPS transmission line has an impedance that is about twice an impedance of the first conductive strip and first patch radiator, and the impedance of the second conductive strip and the second patch radiator. Moreover, the antenna is configured such that the first and second edges are points of opposite phase for a given operating frequency and the first and second patch radiators are fed by the balanced CPS transmission line such that the first and second patch radiators radiate in phase.

These and other exemplary embodiments, aspects, features and advantages of the present invention will be described or become apparent from the following detailed description of exemplary embodiments, which is to be read in connection with the accompanying drawings.

DETAILED DESCRIPTION OF EXEMPLARY EMBODIMENTS

Figure 1:
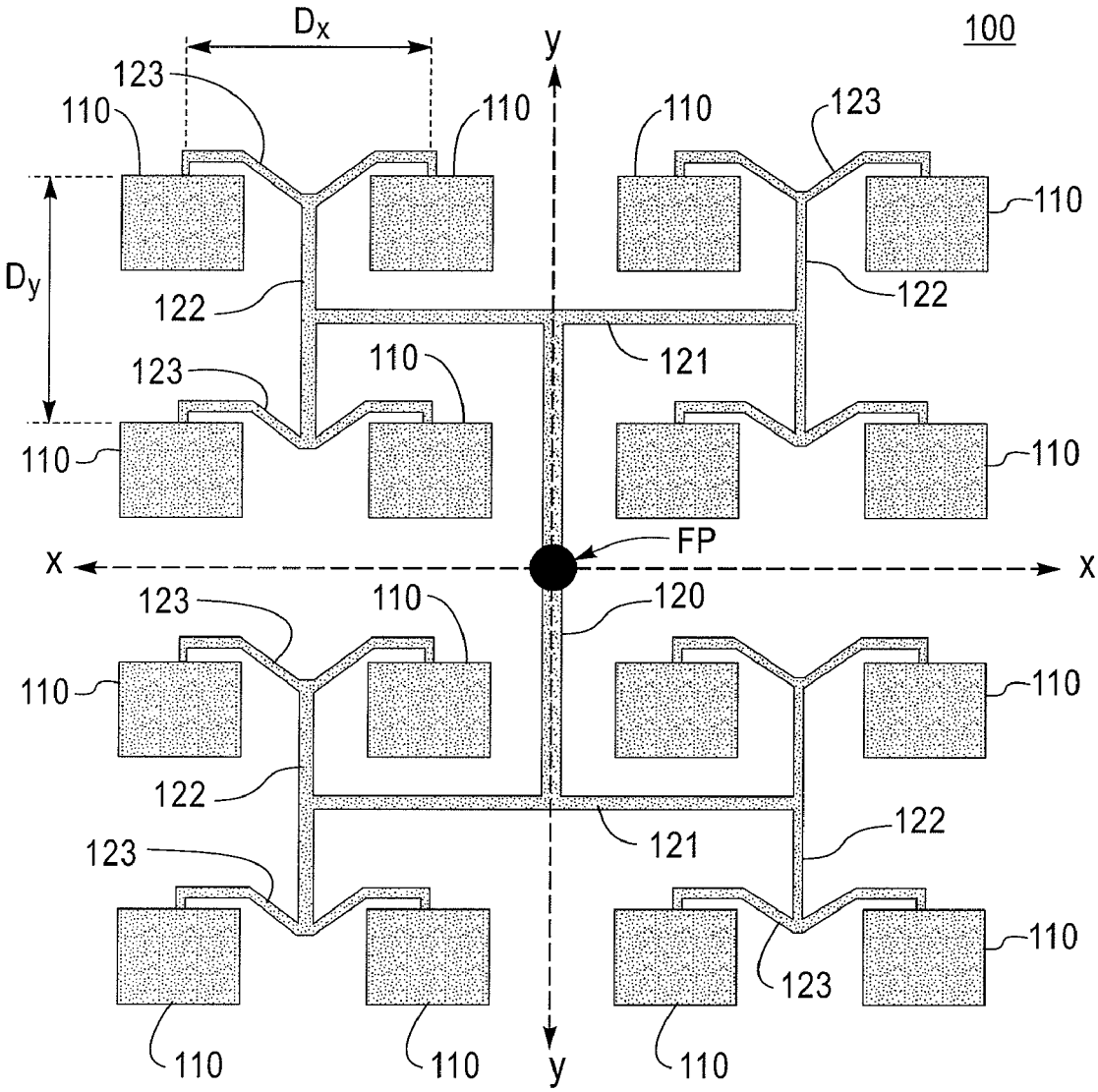
FIG. 1 Prior Art
FIG. 1 schematically illustrates a conventional architecture of a microstrip patch antenna array having a an array microstrip radiator patch elements connected in a microstrip line corporate feed network.
Figure 2A:
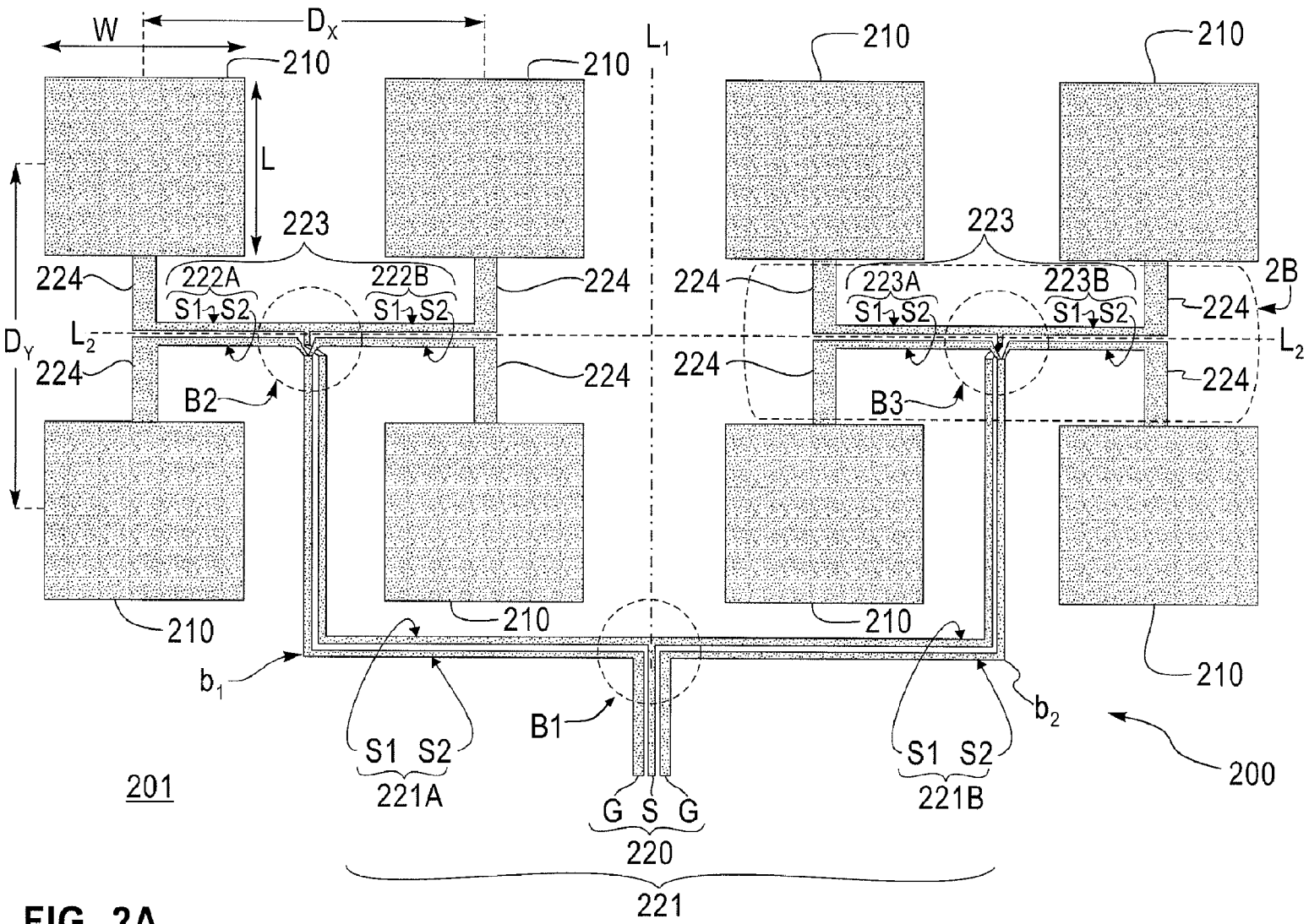
FIGS. 2A~2B are schematic views of an antenna array device comprising an array of planar radiating elements interconnected by a feed network of coplanar transmission lines, according to an exemplary embodiment of the invention.
Figure 2B:
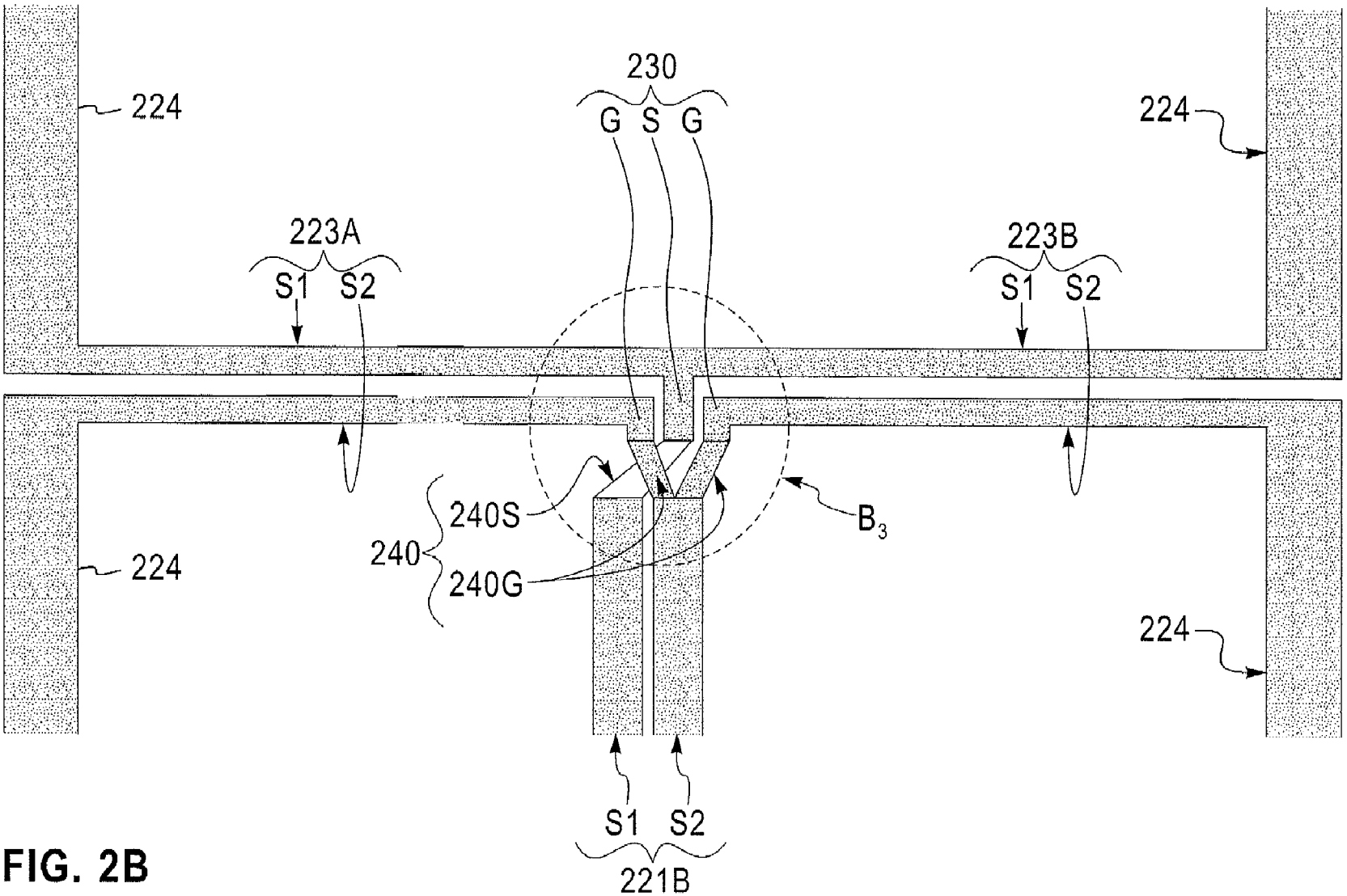

FIGS. 2A~2B are schematic views of an antenna array device comprising an array of planar radiating elements interconnected by a feed network of coplanar transmission lines, according to an exemplary embodiment of the invention. In general, FIG. 2A is a schematic plan view of an antenna array device comprising a planar antenna array (200) that is patterned or otherwise formed on one side of a dielectric substrate (201). FIG. 23 is a detailed plan view of the portion of the planar antenna array (200) within the dashed region 2B shown in FIG. 2A. In general, the planar antenna array (200) comprises an array of radiating patch elements (210) that are uniformly arranged in rows and columns (2×4) of patch elements (210). The array of patch elements (210) are fed by a corporate structured feed network comprising coplanar transmission lines (220, 221, 222, 223), and short microstrip lines (224) that directly connect to feed points at edges of the patch elements (210). In the exemplary embodiment of FIGS. 2A and 2B, the coplanar transmission lines include coplanar waveguide (CPW) transmission lines (220) and coplanar strip line (CPS) transmission lines (221, 222, 223) that are connected at certain points with balun structures (B1, B2 and B3), which form T-junction power divider/combiner transitions between branching coplanar transmission lines. For example, as will be explained in further detail below, FIG. 2B illustrates an exemplary balun structure that is formed of a short section of CPW transmission line to form a back-to-back CPS-CPW-CPS transition. The exemplary antenna array (200) will be described in further detail below.

Figure 2C:
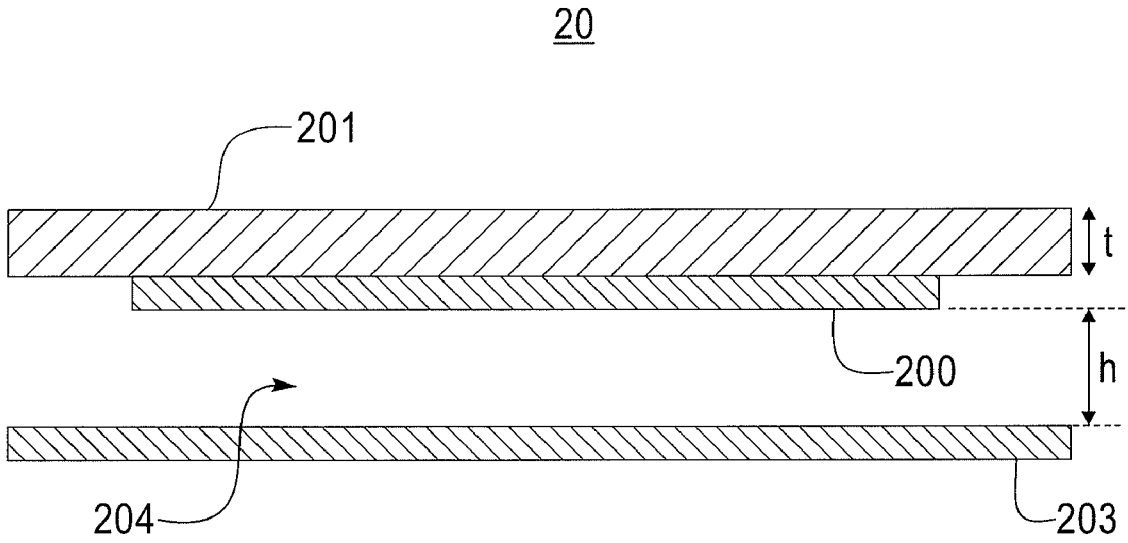
FIG. 2C is a cross-sectional schematic view of an antenna device that may be formed using the planar antenna array structure of FIGS. 2A and 2B in a superstrate framework, according to an exemplary embodiment of the invention.

Depending on the application, the antenna array in FIGS. 2A and 2B can be formed with a ground plane on the opposing side of the substrate (201) is in conventional applications. In other exemplary embodiments, the planar antenna array (200) can be formed on the substrate (201) with no ground plane on the opposing side, but where the substrate (201) is disposed near a separate ground plane in a superstrate arrangement. For instance, FIG. 2C is a cross-sectional schematic view of an antenna device (20) wherein the planar antenna array (200) printed on one side of the planar substrate (201) of thickness (t) is disposed over a ground plane (203) in a superstrate framework, according to an exemplary embodiment of the invention. In this framework, no ground plane is formed on the surface of the substrate (201) opposite the printed antenna array (200). Rather, the ground plane (203) is disposed substantially parallel to planar substrate (201) and facing the antenna array pattern (200), where the ground plane (203) is positioned at a distance (h) from the surface of the printed antenna array (200), thereby forming a space (204) (or cavity) between the ground plane (203) and surface of the substrate (201) on which the printed antenna array (200) is formed. The space/cavity (204) can be filled with air (dielectric constant=1) or filled with a foam material having a relatively low dielectric constant close to that of air (e.g., dielectric constant=1.1). The substrate (201) may comprise any suitable material including, for example, dielectric or insulative materials such as fused silica ($SiO_2$), alumina, polystyrene, ceramic, Teflon based substrates, FR4, etc., or semiconductor materials such as high resistivity silicon or GaAs, etc., depending on the antenna implementation.

The superstrate framework of FIG. 2C enables more efficient construction and operation for high frequency (e.g., millimeter wave) operation as compared to conventional printed circuits. Indeed, in contrast to the an exemplary antenna design with a ground plane on the bottom surface of the substrate, the exemplary antenna framework of FIG. 2C provides both high bandwidth and high efficiency at the same time, which is the result of various factors such as the antenna (20) having a very low dielectric "substrate" (e.g., air cavity (204)) between the printed antenna (200) and ground (203), and the antenna (20) having a high dielectric (201) material above the printed antenna array (200). Moreover, with such antenna design, because much of the electric field will be concentrated in the higher dielectric (201) (e.g., higher dielectric than air "substrate" (204)) above the printed antenna (200) structure, such antenna design provides high efficiency and broad bandwidth.

Referring now to FIGS. 2A and 2B, the exemplary antenna array (200) includes a feed structure that comprises a main CPW feed line (220) connected to a CPS branch line (221) via a balun B1. The CPW line (220) is a planar unbalanced transmission line that includes a signal line S disposed between a pair of ground lines G. The CPS branch line (221) is a balanced transmission line that includes a pair of signal lines S1 and S3. The CPS line (221) includes branch line portions (221A) and (221B) that extend in opposite directions from the balun B1 junction at right angles to the CPW feed line (220). The balun (B1) is designed to provide a transition from the unbalanced CPW line (220) to the balanced CPS line (221) and providing a power dividing T-junction.

In particular, the balun B1 is formed by extending the signal line S of the CPW line (220) through an open (discontinuous) portion of the signal line S2 of the CPS line (221) and connecting the signal line S of the CPW line (220) to the signal line S1 of the CPS line (221). The ground lines G of the CPW (220) are connected to the ends of the signal traces S2. In effect, the balun B1 splits the CPS branch line (221) into two balanced CPS transmission lines (221A) and (221B), providing a matched 3 db power divider (or power combiner) where the impedances of the two branch CPS lines (221A) and (221B) are the same and twice the impedance of the CPW feed line (220). In this instance, the power transmitted on the CPW line (220) will split evenly into the two CPS branch line portions (221A) and (221B).

The CPS branch line (221A) includes a right angle bend (b1) from which the CPS line (221A) extends to a branch CPS line (222) that extends transverse at right angles to the branch CPS line (221A). The branch CPS line (221A) is connected to the branch CPS line (222) via a balun B2 transition forming a T-junction power divider/combiner, where the branch CPS line (221A) branches into two CPS lines (222A) and (222B). Similarly, the CPS branch line (221B) includes a right angle bend (b2) from which the CPS line (221B) extends to a branch CPS line (223) which extends transverse at right angles to the branch CPS line (221B). The branch CPS line (221B) is connected to the branch CPS line (223) via a balun B3 transition forming a T-junction power divider/combiner. In one exemplary embodiment of the invention, each balun B2 and B3 is formed of a back to back CPS-to-CPW-to-CPS transition structure, as will be explained with reference to FIG. 2B.

FIG. 2B is an detailed plan view of the portion of the antenna pattern (200) within the dashed region 2B shown in FIG. 2A, where the branch CPS line (221B) branches into the two branch CPS lines (223A) and (223B) of the transversely disposed CPS line (223). In general, the balun B3 comprises a first transition (CPS-to-CPW transition) where the branch CPS line (221B) transitions to a CPW line (230) via a transition (240), and a second transition (CPW-to CPS transition) where the CPW line (230) is directly attached to the CPS line (223) forming a T-junction transition to the CPS lines (223A) and (223B).

The CPW line (230) of the balun (B3) includes a signal line S interposed between two ground lines G. The CPW-to-CPS transition structure of the balun 83 is similar to the transition of the balun B1 discussed above, where the signal line S of the CPW line (233) extends through an open (discontinuous) portion of the signal line S2 of the CPS line (223) and connects to the signal line S1 of the CPS line (223) (which branches into signal lines S1 of branch CPS lines (223A) and (223B). Moreover, the ground lines G of the CPW (230) are connected to the ends of the separate signal traces S2 of the branch lines (223A) and (223B).

As further shown in FIG. 2B, the transition (240) from the CPS (221B) to the CPW line (230) includes a signal strip (240S) and ground strips (240G). The ground strips (240G) connect the signal conductor S2 of the CPS line (221B) to the ground lines G of the CPW line (230), while the signal strip (240S) connects the signal line S1 of the CPS line (221B) to the signal line S of the CPW line (230). In one exemplary embodiment of the invention, the ground strips (240G) of the transition (240) are printed patterns that are formed on the surface of the substrate and coplanar with the transmission line traces. The signal strip (240S) of the transition (240) extends over (air bridge or insulator design) the ground strip (240G) or extends below the ground strip (240G) and connects to the signal line S of the CPW (230), thereby forming a CPS-to-CPW transition.

The balun B2 transition in FIG. 2A is similar in structure to the balun B3 depicted in FIG. 2B. In FIG. 2A, the balun B2 is designed to connect the signal line S1 of the CPS line (221A) to the signal lines S1 of the two branch CPS lines (222A) and (222B), and to connect the signal line S2 of the CPS line (221A) to the signal lines S2 of the branch CPS lines (223A) and (223B).

As further depicted in FIGS. 2A and 2B, the feed network further includes short microstrip lines (224) that connect the branch end portion of the branch CPS lines (222) and (223) to respective pairs of patch elements (210). In particular, each branch CPS line (222A) and (222B) feeds a pair of patch elements (210) via separate microstrip lines (224) which extend at right angles between the ends of the branch lines (222A) and (222B), and each branch CPS line (223A) and (223B) feeds a pair of patch elements (210) via separate microstrip lines (224) which extend at right angles between the ends of the branch lines (223A) and (223B).

The exemplary antenna array arrangement depicted in FIGS. 2A and 2B is configured to maximize antenna gain and radiation efficiency. In general, the antenna array is designed so that each patch element (210) is fed with substantially an equal amount of excitation current (power) and with the appropriate phases so that each patch element (210) radiates in phase. In one exemplary embodiment of the invention, the patch elements (210) are rectangular patches having a length L and width W. The length L of each patch element (210) is about $\lambda g/2$ where $\lambda g$ is the substrate (or superstrate) dielectric wavelength at the operating frequency. The width W of the patch element (210) constitutes radiating slots of the patch and thus affects radiation efficiency and antenna input impedance. The width W may be selected to be the same as or similar to the length L. The inter-element spacing in the column direction Dy is $\lambda o/2$ and the inter-element spacing in the row direction Dx can be selected as $\lambda o/2$.

The antenna array (200) achieves in-phase radiation of the patch elements (210) by ensuring symmetry about lines L1-L1 and L2-L2 in FIG. 2A, so that each patch element (210) is located at equal distances from the input feed point of the CPW line (220). Moreover, given the $\lambda o/2$ inter-element spacing Dy between the patch pairs feed by the CPS lines (222) and (223), and given that each of said patch pairs are feed (via strips (224) at their adjacent, facing edges (which are points at which the E-fields are 180 degrees out of phase), phase compensation is achieved by differentially feeding the radiator patch elements (210) elements pairs by the separate signal lines S1 and S2 of the balanced transmission lines (222) and (223). In other words, despite the adjacent feed edges of the patch pairs being points at which the E-fields would be 180 degrees out of phase, these adjacent edges are differentially fed with out of phase signals S1 and S2 so that the patch pairs effectively radiate in phase. This framework allows for a decrease in the inter-element spacing Dy in the column direction due to the phase reversal at the feed points of the two adjacent radiator elements at points of opposite phase—since the radiator patch feed at opposite ends, the pair will radiator in phase.

Moreover, to evenly distribute the power to/from the patch elements (210) and to minimize losses/reflections in the feed network, impedance matching between each element and the feed network, as well as within the feed network, to prevent reflections. In one exemplary embodiment, the feed network is designed so that the input impedance of the patch (210) and microstrip line (224) as seen from the branch CPS connection is transformed by the power divider network to a desired impedance at the input to the antenna array, where impedance matching within the feed network is achieved by using coplanar strip lines having different widths (different impedances) such that at a point where a single line divides into two, the parallel combination of the impedance of the two lines is equal to that of the single line. For instance, assume that impedance of the patch (210) and microstrip feed line (224) are 100 ohms at the resonant operating frequency. The CPS lines (222) and (223) would foe designed to have a characteristic impedance of about 200 ohms (each line S1 and S2 of the CPS lines (222) and (223) would effectively have an impedance of 100 ohms to match the input impedance of 100 ohms of the patch (21)/microstrip (224) combination. The impedance of the CPS branch lines (222A/B) and (223A/B) can be selected by, e.g., varying the width of the signal lines S1 and S1 and the spacing between the lines, as is understood by those of ordinary skill in the art. In this regard, the impedance at the junctions of the balun B2 and B3 would be about 100 ohms (as the impedance would be determined by a pair of 200 ohm resistors in parallel). To match this 100-ohm resistance, each branch 221A, 221B of the CPS line (221) would be designed to have an impedance of about 100 ohms at the operating frequency. At the junction between the CPS line (221) and the input CPW line (220), an effective resistance of 50 ohms would be seen as determined by the parallel 100 ohm resistance of the branch CPS lines (221A and 221B). The input CPW line (220) would be designed to have an impedance of 50 ohms (at the resonant frequency). In this manner, the impedance of the CPW line (220) (e.g., 50 ohms) can be matched to the impedance of each patch (210) and microstrip feed line (224) (100 ohms) via effective power division over the feed network.

Moreover, transmission line losses (resistive, radiation, etc.) are minimized by implementing the CPS and CPW feed network architectures. Indeed, since CPS and CPW lines have a reliable return current path, the line characteristic impedance remains substantially constant in the operating frequency band of interest regardless of the thickness of the substrate (201). Moreover, the field remain primarily between the coplanar signal lines and ground lines, so the fringed field is weak. As a result, the coupling between feed lines and between feed lines and the radiating elements are weak. This makes the feed structure and radiating elements design much easier.

Figure 3:
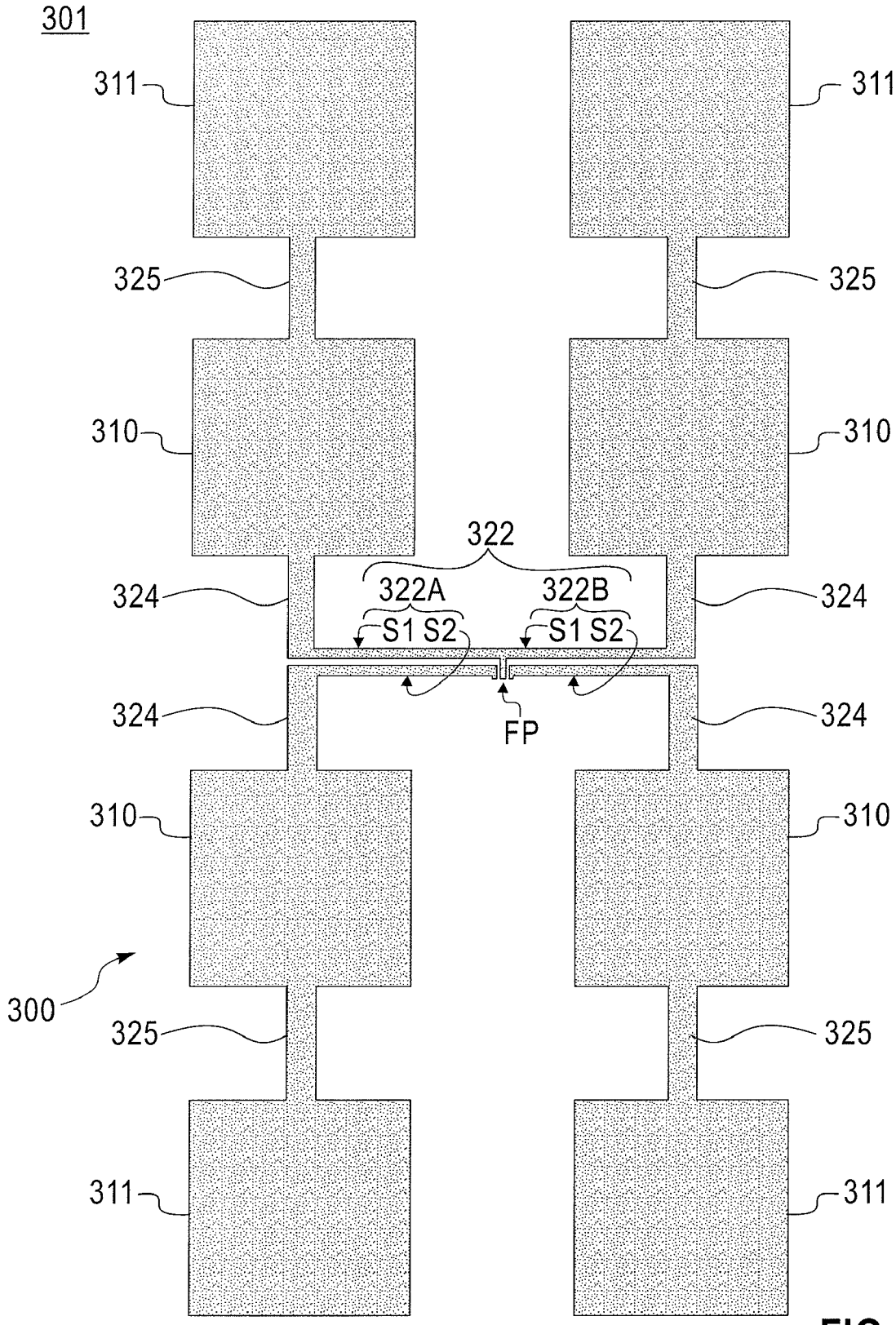
FIG. 3 is a schematic plan view of an antenna array device comprising an array of planar radiating elements interconnected by a feed network of coplanar transmission lines, according to another exemplary embodiment of the invention.

With the proposed feed network, a combination of series and parallel patches are possible as shown in FIG. 3 while still maintaining the maximum radiation at the broadside direction. In particular, FIG. 3 is a schematic plan view of an antenna array device comprising a planar antenna array (300) that is patterned or otherwise formed on one side of a dielectric substrate (301). In general, the planar antenna array (300) comprises an array of radiating patch elements (310) and (311) that are uniformly arranged in rows and columns. The array of patch elements (310) are fed by a corporate structured feed network comprising coplanar transmission lines (322) and short microstrip lines (324) that directly connect to feed points at edges of the patch elements (310).

Each branch CPS line (322A) and (322B) feeds a pair of patch elements (310) via separate microstrip lines (324) which extend at right angles to the branch lines (322A, 322B. In the exemplary embodiment, the radiator elements pairs (310) in the column direction are conductively joined to respective the different signal lines S1 and S2 of the balanced transmission lines (322) such the each radiator patch (310) is feed at opposite ends, the pair will radiator in phase. This allows the inter-element spacing Dy in the column direction to $\lambda o/2$ at the desired operating frequency. Moreover, a plurality of series connected patches (311) are conductively joined to respective patches (310) by thin conductive microstrip lines (325). In each series feed line, the radiator elements are conductively joined at opposite, adjacent edges. The patches (310) and (311) have resonant lengths of $\lambda g/2$ and the lengths of the microstrips (325) are about $\lambda g/2$. In this arrangement all patch elements (310) and (311) will radiate in phase.

Figure 4A:
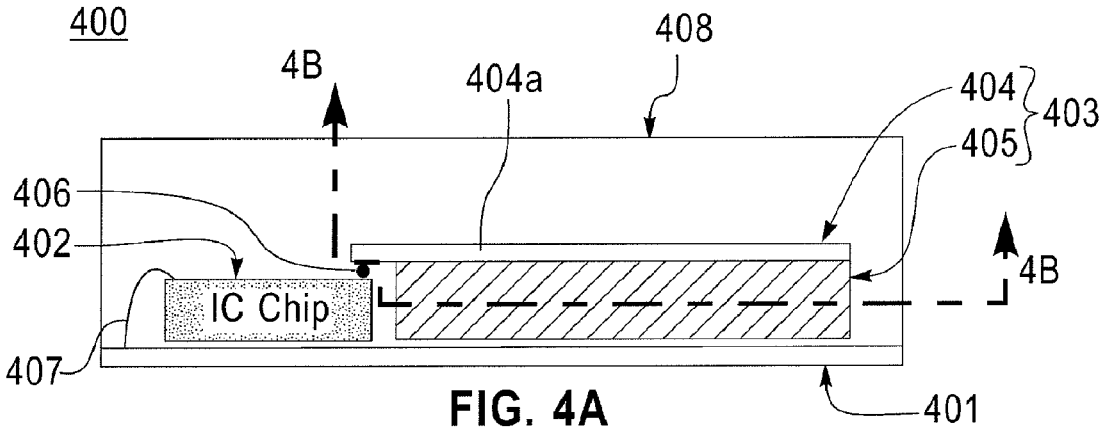
FIGS. 4A and 4B are schematic views of package structure for integrally packaging the antenna device of FIGS. 2A and 2B with an integrated circuit chip in a superstrate framework as depicted in FIG. 2C, according to an exemplary embodiment of the invention.

As noted above, exemplary antenna arrays can be constructed using a superstrate framework where no ground plane is disposed on the back of the antenna substrate. FIGS. 4A and 48 schematically illustrate an apparatus for integrally packaging an antenna and IC chip, according to an exemplary embodiment of the present invention. In general, FIG. 4A illustrates an electronic package apparatus (400) comprising a package frame structure (401), an integrated circuit chip (402) backside mounted to the package frame (401), an integrated antenna module (403) mounted to the package frame (401). The package frame can be one of various types of package structures including, but not limited to, package cores, substrates, carriers, die paddies, lead frames, etc., and other package structures that provide functions such as mechanical stability, chip mounting, electrical interface, etc.

The antenna module (403) comprises an integrated antenna device (404) mounted to an antenna socket structure (405). The integrated antenna device (404) comprises a planar substrate (404*a*) mounted to the socket structure (405), which (as depicted in FIG. 48), may have a printed antenna array (200) and feed line structure as depicted iii FIG. 2A, printed or otherwise formed on a surface (bottom surface) of the planar substrate (201).

Figure 4B:
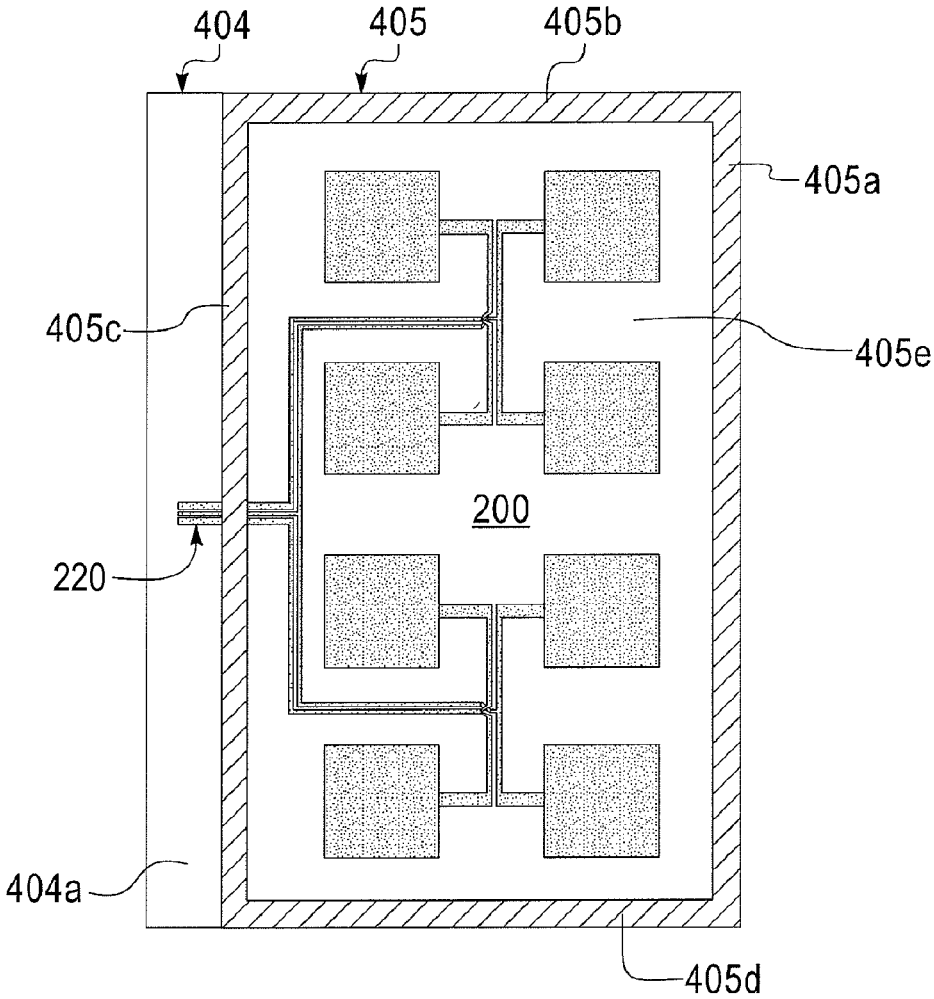

As further depicted in FIG. 4A, a portion of the integrated antenna device (404) extends past a side edge of the socket structure (405) and is disposed above the active surface of the chip (402). A solder ball connector (406) provides an electrical connection between a contact I/O pad on the active surface of the chip (402) and an antenna feed structure formed on the integrated antenna device (404), for example. For example, as depicted in FIG. 4B, the input feed may be the CPW line (220) that feeds the input to the antenna array (200). The apparatus (400) further comprises wire bonds (407) that provide electrical connections (for I/O signals and power) between bond pads on the active surface of the IC chip (402) and appropriate connectors/pads/leads of the package frame (401). The package (400) includes a package mold (408) (or package encapsulation), which can be formed using known plastic materials for forming the package encapsulation layer (408).

In general, the socket structure (405) is designed to shield the antenna radiators from the surrounding materials and components of the package apparatus (400), thereby providing a closed EM environment allowing the antenna to be designed with a desired performance irrespective of the package structures and technologies. FIG. 4B schematically illustrates an exemplary embodiment of the integrated antenna module (403) of FIG. 4A. In particular, FIG. 4B is a schematic plan view of the antenna module (403) from a viewpoint along line 4B-4B in FIG. 4A in the direction of the arrows (i.e., in the exemplary embodiment, viewing the bottom surface of the substrate (404*a*) of the antenna device (404)) comprising the antenna array (200) and feed line pattern of FIG. 2A.

Further, as depicted in FIG. 4B, the socket structure (405) may comprises a rectangular structure with outer walls (405*a*, 405*b*, 405*c*, and 405*d*) that surround and define an inner region (405*e*). The antenna substrate (404*a*) is mounted (via suitable bonding material) to the socket (405) such that the printed antenna structure (200) is aligned to and faces the inner region (405*e*). The CPW line (220) extends through a small aperture or opening in the outer socket wail (405*c*) to enable electrical connection to the feed line (e.g., bonding balls (406) in FIG. 4A).

The socket structure (405) can have any suitable framework. For example, the antenna socket structure (405) can be a hollow metallic structure formed from metallic material (e.g., copper, aluminum) having outer walls (405*a*.about.405*d*) and a planar metallic (bottom) surface, wherein the metallic bottom surface is bonded to the package frame (401). With this framework, the socket structure (405) provides a defined cavity region having metallic sidewalls and bottom surface, wherein the bottom surface of the socket provides a reference ground or reflector for the antenna. With the antenna substrate (404*a*) mounted to the socket structure (405), the radiating elements of the antenna (200) are disposed within a predefined, closed EM environment and are shielded from the surrounding package material. Indeed, the socket structure (405) provides a natural barrier to prevent lossy encapsulant material from flowing into the enclosed cavity region between the printed antenna (200) and reference ground during an encapsulation process.

In other exemplary embodiments of the invention, the socket structure (405) can be a metallic/dielectric frame structure comprising outer walls (405*a*-405*d*) with no planar bottom (ground) surface. With this structure, a metallic ground plane can be formed on (or integrally formed from) the package frame (401), whereby the antenna socket structure (405) is mounted to the package frame (401) such that the inner region (405*e*) is aligned to the metallic ground plane. As with an exemplary socket structure providing an integrally formed ground plane, the ground plane of the package frame (401) operates as an antenna reference ground or reflector to ensure that no energy is radiated into the hoard on which the package (400) is mounted. In all instances, the metallic ground plane effectively limits the antenna radiation to the upper hemisphere above the antenna and enables consistent antenna performance.

It is to be further appreciated that exemplary antenna modules with providing closed cavity regions with controlled EM environments and reference ground planes renders antenna performance less sensitive to the ground size and surrounding dielectric material. For instance, a controlled air space provides better bandwidth and radiation efficiency for the antenna. In comparison to conventional antenna designs with floating ground planes of a same size, a closed cavity region reduces unwanted backside radiation.

It is to be understood that the exemplary package of FIGS. 4A and 4B are merely exemplary embodiments for packaging antenna arrays with chips, and that antenna modules and package structures can be designed with varying shapes, structures, layouts, configurations, materials, etc., depending on the application and desired performance. For example, with regard to antenna modules, the socket structures can foe constructed with different metallic or low loss dielectric materials and with varying shapes. For instance, socket structures can foe square, rectangular, round or oval-shaped. The types of socket material used and the size/structures of the closed cavity regions may be varied to optimize various parameters (gain, match, efficiency and pattern. The cavity regions of hollow socket structures can foe filled with air, or low-loss and low dielectric materials (e.g., foam).

Furthermore, various types of IC chips may foe integrally packaged with an antenna module to construct electronic devices having highly integrated, compact radio communications systems. For instance, the IC chip (402) may be an integrated transceiver circuit, an integrated receiver circuit, an integrated transmitter circuit, and/or other support circuitry, etc., can be packaged with one or more antenna modules to provide compact radio communications chips. These radio communications chips can be installed in various types of devices for wireless communication applications.

In other exemplary embodiments, the input CPW feed line (220) may foe a balanced CPS line, or combination of CPW and CPW with an appropriate transition, to provide the necessary inductive/capacitive impedance matching between a device/component (e.g., power amplifier, LNA, etc.) formed on the IC chip and the printed antenna structure, and provide the necessary impedance depending on, e.g., the impedance that is need for the given application and/or the type of devices to which the antenna may be connected. For example, if the antenna is connected to an integrated transmitter system, the input feed line (220) of the feed network of the antenna array (200) will be designed to provide the proper connections and impedance matching for, e.g., a power amplifier. By way of further example, if the antenna array (100) is connected to a receiver system, the feed network may be designed to provide the proper connections and impedance matching for, e.g., an LNA (low noise amplifier).

Moreover, although FIG. 4A depicts a flip-chip ball bond connection between the chip (402) and antenna input feed line (220), other interconnect technologies such as wire bonding can be used to make electrical connections between the contacts of the chip (402) and antenna substrate (404*a*). In some applications, the use of wire bonding relaxes mechanical stress that may arise due to different material expansion coefficients of the chip (402) and the antenna (404).

Although exemplary embodiments have been described herein with reference to the accompanying drawings for purposes of illustration, it is to be understood that the present invention is not limited to those precise embodiments, and that various other changes and modifications may be affected herein by one skilled in the art without departing from the scope of the invention.

We claim:

1. An antenna, comprising:

a planar substrate comprising an antenna array comprising an array of planar radiating elements and a feed network formed on a surface of the planar substrate;

wherein the planar radiating elements include a first pair of patch radiators including a first patch radiator having a first edge, and a second patch radiator having a second edge, wherein the first and second patch radiators are arranged such that the first and second edges are adjacent edges that are spaced apart and face each other;

wherein the planar radiating elements include a second pair of patch radiators including a third patch radiator having a third edge, and a fourth patch radiator having a fourth edge, wherein the third and fourth patch radiators are arranged such that the third and fourth edges are adjacent edges that are spaced apart and face each other;

wherein the feed network comprises:

a first balanced coplanar strip line having first and second signal lines;

a first conductive strip connecting the first signal line to the first edge of the first patch radiator and to the third edge of the third patch radiator; and a second conductive strip connecting the second signal line to the second edge of the second radiator patch and to the fourth edge of the fourth patch radiator.

2. The antenna of claim 1, wherein the first and second patch radiators are rectangular patch elements having a length L and width W, wherein the first and second edges define the widths W of the first and second patch radiator elements.

3. The antenna of claim 1, wherein the first balanced coplanar strip line has an impedance that is about twice an impedance of the first conductive strip and first patch radiator, and the impedance of the second conductive strip and the second patch radiator.

4. The antenna of claim 1, wherein the antenna is configured such that the first and second edges are points of opposite phase for a given operating frequency and the first and second patch radiators are fed by the first balanced coplanar strip line such that the first and second patch radiators radiate in phase.

5. The antenna of claim 1, wherein the feed network further comprises:

a second balanced coplanar strip line extending transverse to the first balanced coplanar strip line;

a balun connecting the first and second balanced coplanar strip lines, wherein the balun comprises a coplanar waveguide transmission line.

6. The antenna of claim 5, wherein the balun comprises a back-to-back CPS to CPW to CPS transition.

7. The antenna of claim 1, wherein the feed network further comprises:

a coplanar waveguide transmission line extending transverse to the first balanced coplanar strip line;

a balun connecting the first balanced coplanar strip line and the coplanar waveguide transmission line.

8. The antenna of claim 1, further comprising a ground plane disposed on a surface of the substrate opposite the antenna array.

9. An antenna, comprising:

a planar substrate comprising an antenna array comprising an array of planar radiating elements and a feed network formed on a surface of the planar substrate;

wherein the feed network comprises a network of coplanar strip line transmission lines that include one or more coplanar strip lines (CPS) and one or more coplanar waveguide (CPW) transmission lines, wherein the CPW includes a signal line S disposed between a pair of ground lines G, and wherein each CPS includes a first signal line extending transversely from the signal line S at a T-junction of the signal line S and a second signal line connected to one of the ground lines G.

10. The antenna of claim 9, wherein the feed network comprises a corporate feed structure.

11. The antenna of claim 9, wherein the feed network further comprises a balun to connect a CPW and CPS transmission line which are transversely disposed to each other.

12. The antenna of claim 9, wherein the feed network further comprises a balun to connect first and second CPS transmission lines that are transversely disposed to each other.

13. The antenna of claim 12, wherein the balun comprises a back-to-back CPS to CPW to CPS transition.

14. The antenna of claim 9, wherein the planar radiating elements are arranged in pairs where each pair of radiating elements is differentially fed by a balanced CPS transmission line.

15. The antenna of claim 14, wherein the radiating elements are rectangular patch elements.

16. The antenna of claim 14, wherein each pair of radiating elements includes a first patch, radiator having a first edge, and a second patch radiator having a second edge, wherein the first and second patch radiators are arranged such that the first and second edges are adjacent edges that are spaced apart and face each other;

wherein the planar radiating elements include a second pair of patch radiators including a third patch radiator having a third edge, and a fourth patch radiator having a fourth edge, wherein the third and fourth patch radiators are arranged such that the third and fourth edges are adjacent edges that are spaced apart and face each other;

wherein the balanced CPS transmission line includes the first and second signal lines, wherein a first conductive strip connects the first signal line to the first edge of the first patch radiator and to the third edge of the third patch radiator, and a second conductive strip connects the second signal line to the second edge of the second radiator patch and to the fourth edge of the fourth patch radiator.

17. The antenna of claim 16, wherein the balanced CPS transmission line has an impedance that is about twice an impedance of the first conductive strip and first patch radiator, and the impedance of the second conductive strip and the second patch radiator.

18. The antenna of claim 16, wherein the antenna is configured such that the first and second edges are points of opposite phase for a given operating frequency and the first and second patch radiators are fed by the balanced CPS transmission line such that the first and second patch radiators radiate in phase.

19. The antenna of claim 9, wherein the feed network comprises a combination of a corporate feed structure and a series feed network.

* * * * *